United States Patent [19]

Fuller

[11] 4,094,768

[45] June 13, 1978

[54] SEPARATION OF BITUMEN FROM TAR SANDS USING SULFUR AND WATER

[75] Inventor: Everett J. Fuller, Gillette, N.J.

[73] Assignee: Exxon Research & Engineering Co., Linden, N.J.

[21] Appl. No.: 756,643

[22] Filed: Jan. 4, 1977

[51] Int. Cl.[2] ..... C10G 1/04

[52] U.S. Cl. ..... 208/11 LE

[58] Field of Search ..... 208/11 LE

[56] References Cited

U.S. PATENT DOCUMENTS 3,929,193 12/1975 Duke ..... 208/11 LE

*Primary Examiner*—Delbert E. Gantz

*Assistant Examiner*—James W. Hellwege

*Attorney, Agent, or Firm*—Edward M. Corcoran

[57] ABSTRACT

A relatively low temperature process for separating and recovering bitumen from natural tar sands wherein granular sulfur and water are mixed with the tar sand, in the presence of air, to form a sulfur-bitumen agglomerate which floats on the water, with relatively bitumen-free sand sinking to the bottom. The agglomerate may be skimmed off the surface of the water and bitumen recovered therefrom by heating the agglomerate to melt the sulfur and then separating the molten sulfur from the hot bitumen. It has unexpectedly been discovered that a yield of over 80% of bitumen can be recovered from the tar sands by the use of sulfur in the process, compared to only about 20% if sulfur is not present.

13 Claims, 2 Drawing Figures

SULFUR FLOTATION OF TAR-SAND BITUMEN AT 104° F

SEPARATION OF BITUMEN FROM TAR SANDS USING SULFUR AND WATER

BACKGROUND OF THE INVENTION

1. Field of the Invention

This invention relates to a process for recovering bitumen from natural tar sands. More particularly, this invention relates to a relatively low temperature process for recovering bitumen from tar sands which includes mixing the tar sands with granular sulfur and water in the presence of air thereby forming a sulfur-bitumen agglomerate which floats on the water and is then separated from the water and sand. The bitumen is recovered from the agglomerate by heating the sulfur-bitumen agglomerate to melt the sulfur and then separating the molten sulfur from the hot bitumen.

2. Description of the Prior Art

Bitumens are hydrocarbon materials of natural or pyrogenous origin frequently found in liquid, semi-solid or solid form. Tar sands containing various types of bitumen hydrocarbons exist in various areas of the world as, for example, the heavy deposits of Athabasca tar sands existing in Canada. These sands contain large reserves of bitumen type hydrocarbon constituents. For example, the bitumens or oil in the sands may vary from about 5 to 21% by volume and generally occurs in an amount of about 12% by volume. The gravity of this bitumen or oil ranges from about 6° to 10° API with an average value generally of about 8° API. These sands exist as beds ranging from about 100 to 400 feet thick below at least about 200 feet of overburden. A typical oil recovered from tar sands has an initial boiling point of about 300° F and about 50% of the oil boils above about 950° F. The recovery of bitumen hydrocarbons from tar sands in the past has not been effective to any great extent due to deficiencies in operating techniques for the recovery of these hydrocarbons. For example, a relatively small amount of clay (from about 0 to 30%, usually about 5%) in the sand greatly retards the recovery of the oil when utilizing conventional water techniques. Apparently the oil in the clay forms skins which envelope small pockets of water often containing finely divided sand. These enveloped pockets are distributed in the water by mixing operations which tend to form foams and emulsions, thereby resulting in incomplete separation, hard to manage foams and the need for heat to bring the emulsions under control.

Various attempts have been made in the past to recover bitumen from the Athabasca tar sands. One method that has been suggested is to add a solvent to the tar sands in order to reduce the viscosity of the bitumen and, in conjunction with water, flow the bitumen-solvent mixture away from the sand. While this technique achieves a good separation of bitumen from the sand, the water addition results in the formation of foams, stable emulsions and sludges which are than very difficult to separate from the water and requires extensive supplementary processing in order to achieve reasonable yields of oil.

Various thermal processes have also been suggested for recovering bitumen from tar sands as mined, such as heat soaking, visbreaking, etc. However, in these processes a large amount of heat is transmitted to the sand and cannot be efficiently and effectively recovered therefrom. Also, if heat soaking is employed, large soaking vessels are required and the operation is essentially a batch-type operation which produces large amounts of coke. This coke must then be broken up and removed from the heat soaking vessels. U.S. Pat. No. 3,153,625 discloses a fluid coking type of operation for recovering oil from tar sands wherein the tar sands as mined are mixed with coke particles from a fluid coker and water. This results in the formation of three phases; water, a quantity of relatively bitumen-free sand and a mixture of bitumen, sand and coke. The mixture of bitumen, sand and coke is then processed via either a solvent treating operation or by passing same to a fluid coker. The coke produced in the coker may then be recycled back into the process. Unfortunately, this process suffers from the disadvantages of having to deal with large quantities of sand and coke as well as requiring a great deal of heat in order to operate the fluid coker.

The best known methods for separating bitumen from tar sands involve the use of water for preparing a hot slurry and are the so-called "hot water" processes which also involve the use of froth flotation for separating the bitumen from the sand and water. In the hot water processes, the tar sands are generally mixed with water and a caustic material and then heated with steam to a temperature of at least about 180° F. The mixing or slurrying operation is generally a two-stage process wherein a first slurry containing a critical amount (i.e. ~ 15 wt.%) of water is prepared under conditions of a high energy shear-type of mixing with the slurry resulting therefrom then agitated with a stream of circulating hot water in an amount ranging from about 60 to 100 wt.% based on the weight of the tar sand to form a second slurry which is then passed to a separation cell maintained at a temperature of at least about 180° F. In the separation cell, air entrained in the mixing process causes the bitumen to rise to the top of the cell and form a froth. The froth comprises air, the bitumen and some water. Also present in the froth are small amounts of fine clay, silt or sand mineral solids having a particle size less than about 50 microns and in an amount of about 2 to 10 wt.% of the froth. This process separates the bitumen from the bulk of the tar sands. The water and mineral solids are then separated from the froth before the bitumen is sent to further processing. Methods such as gravity settling, cycloning and electrostatic treatment are among those which have been employed for dewatering the froth. In any event, all of the hot water processes use steam and produce the froth at an elevated temperature. This results in the production of a considerable amount of foam which is very difficult to handle on a commercial basis. It would be advantageous if a relatively simple, low temperature process for separating bitumen from tar sands could be developed.

SUMMARY OF THE INVENTION

What has now been discovered is a relatively low temperature water process for separating bitumen from natural tar sands which comprises mixing said tar sands with water and sulfur particles to form three phases, a sulfur-bitumen agglomerate phase, a sand phase and a water phase and wherein the sand and water are separated from the agglomerate and bitumen is recovered from said agglomerate. It is preferred to mix the tar sand, water and sulfur particles in the presence of air or other non-reactive gas. If the tar sand, water and sulfur particles are mixed in the presence of air or other non-reactive gas, the air or gas is entrained in the sulfur-bitumen agglomerate which then floats on the surface of the water while the relatively bitumen-free sand sinks to the bottom, thereby readily facilitating separation of the bitumen-sulfur agglomerate from the water and sand. The agglomerate may then simply be skimmed off the surface of the water and the water decanted off the sand. The bitumen may then be separated and recovered from the sulfur-bitumen agglomerate simply by heating same up to the melting point of the sulfur to form two liquid layers or phases, a bitumen phase and a sulfur phase and separating the two via simple decanting. The sulfur can then be cooled down, solidified and recycled back into the process while the bitumen is sent to refining operations.

Finally, the amount of bitumen recovered from the tar sands via the relatively low temperature water process of this invention is somewhat dependent on the amount of sulfur used in the process. As the amount of sulfur used in the process increases, the amount of bitumen recovered from the tar sand initially increases, passes through a maximum value and then decreases.

By low temperature is meant a process wherein the tar sand, sulfur particles, water and air are mixed at a temperature below about 170° F, preferably ranging from between about 90° to about 150° F and more preferably from about 95° to 140° F. Particularly preferred are temperatures ranging between about 100° to 125° F. The amount of water used in the process will range from about 40 to 400 wt.% of the tar sand. The grain size of the sulfur particles can vary within the range of from between about 1 to 100 microns. The smaller the grain size the better is the coalescing or agglomerating effect provided by the sulfur particles. However, the commercial production of grain sizes much below 5 microns may be impractical and using such a fine powder could introduce problems in handling and containment of dusts. It may be noted that sulfur particles of a size of approximately 5 mircons do not cause dust problems, can be easily handled without unusual safety precautions and have been observed to agglomerate efficiently with the bitumen or oil phase of the tar sand. Therefore, it may be commercially advantageous to use sulfur particles having an average particle size of no less than about 5 microns. As to an upper particle size limit, it is well understood that as the particle size increases, surface area reduction occurs per unit weight of sulfur which will become limiting on a practical basis. This may readily be determined experimentally. The amount of sulfur added to the tar sand depends on the bitumen content of same and the viscosity of the bitumen. In general, this will range from about 1 to 30 wt.% of the tar sand feed, more preferably from 2 to 5 wt.% and most preferably from 3 to 10 wt.%.

DETAILED DESCRIPTION

Figure 1:
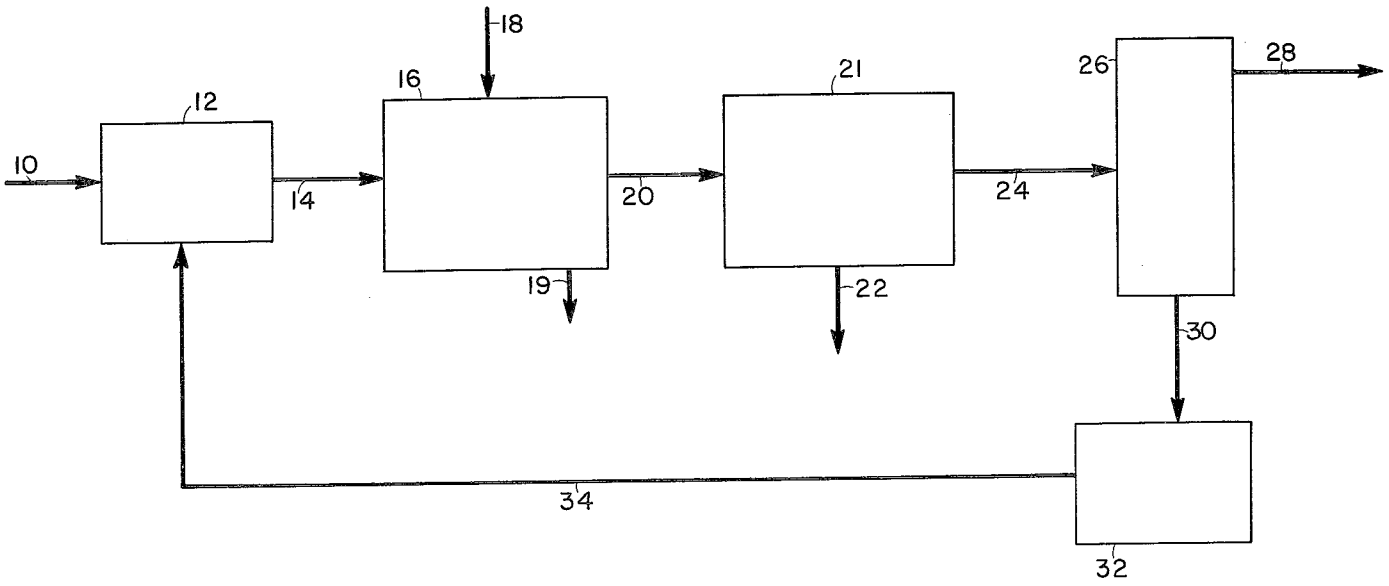
FIG. 1 is a flow diagram of a preferred embodiment of the process of the instant invention.

Referring to FIG. 1, tar sands as mined along with particles of solid sulfur are introduced into grinding zone 12 via lines 10 and 34, respectively. The amount of sulfur added will of course vary with the nature of the tar sand used and the temperature at which the process is carried out. With Athabasca tar sand the amount of sulfur added to zone 12 will generally range from between 2 to 10 wt.% of the tar sand when the mixing temperature to which the tar sand, sulfur and water are ultimately mixed ranges from between 90° to 150° F. Zone 12 simply functions to break up the tar sand conglomerate and grind the solid sulfur into smaller particles thereby mixing together the tar sand and sulfur. Alternatively, the sulfur added to zone 12 may be small enough in particle size not to require grinding therein in which case zone 12 functions to break up the tar sand conglomerate and mix the sulfur with same. The ground mixture of tar sands and sulfur is then passed to mixing zone 16 via line 14 wherein it is contacted with about 100 wt.% water based on the tar sand feed and agitated in the presence of air said water entering zone 16 via line 18. In mixing zone 16 the sulfur forms an agglomerate with the bitumen from the tar sand, which in the presence of air forms a sulfur-bitumen agglomerate which floats to the surface of the water, thereby releasing relatively bitumen-free sand, which sinks to the bottom of zone 16. Sand and some water are removed from the bottom of zone 16 via line 19 with the remainder of the water and the sulfur-bitumen agglomerate passed to separating zone 21 via line 20 wherein the agglomerate is separated from the water via any suitable means such as simple skimming. Water is removed from zone 21 via line 22 with the sulfur-bitumen agglomerate removed therefrom via line 24 and sent to zone 26 for separating the bitumen from the sulfur. Zone 26 is a heating zone which may be merely a vertical tank with internal or external heating coils for heating the agglomerate to the melting point of the sulfur which, depending upon its purity, will range anywhere from 220° to 250° F. Generally, the sulfur-bitumen agglomerate is heated to a temperature of at least about 245° to 250° F. The bitumen being lighter than the sulfur floats to the top and is removed via line 28 and sent to further processing in order to recover useful hydrocarbon products therefrom. The molten sulfur is withdrawn from the bottom of zone 26 via line 30 and sent to zone 32 wherein it is cooled into a solid form, or dispersed in water to form small particles. The sulfur particles from zone 32 are then recycled back to grinding zone 12 wherein same are mixed with fresh incoming tar sands.

PREFERRED EMBODIMENT

The invention may be more readily understood by reference to the following examples.

EXAMPLE 1

Five parts by weight of Athabasca tar sand containing 10 wt.% bitumen were added into each of three glass containers. To each container was added an equal amount by weight of water at room temperature. Elemental sulfur having a particle size ranging from about 1 to 10 microns was added to two of the containers in an amount shown in Table 1 and all three containers were closed and well shaken by hand. The containers were about three-quarters full. The observations of this experiment are listed in the table, and show that the best visible agglomeration of the bitumen by the sulfur took place in container B wherein the bitumen completely agglomerated with the sulfur thereby releasing clean, bitumen-free sand and clean water.

EXAMPLE 2

Figure 2:
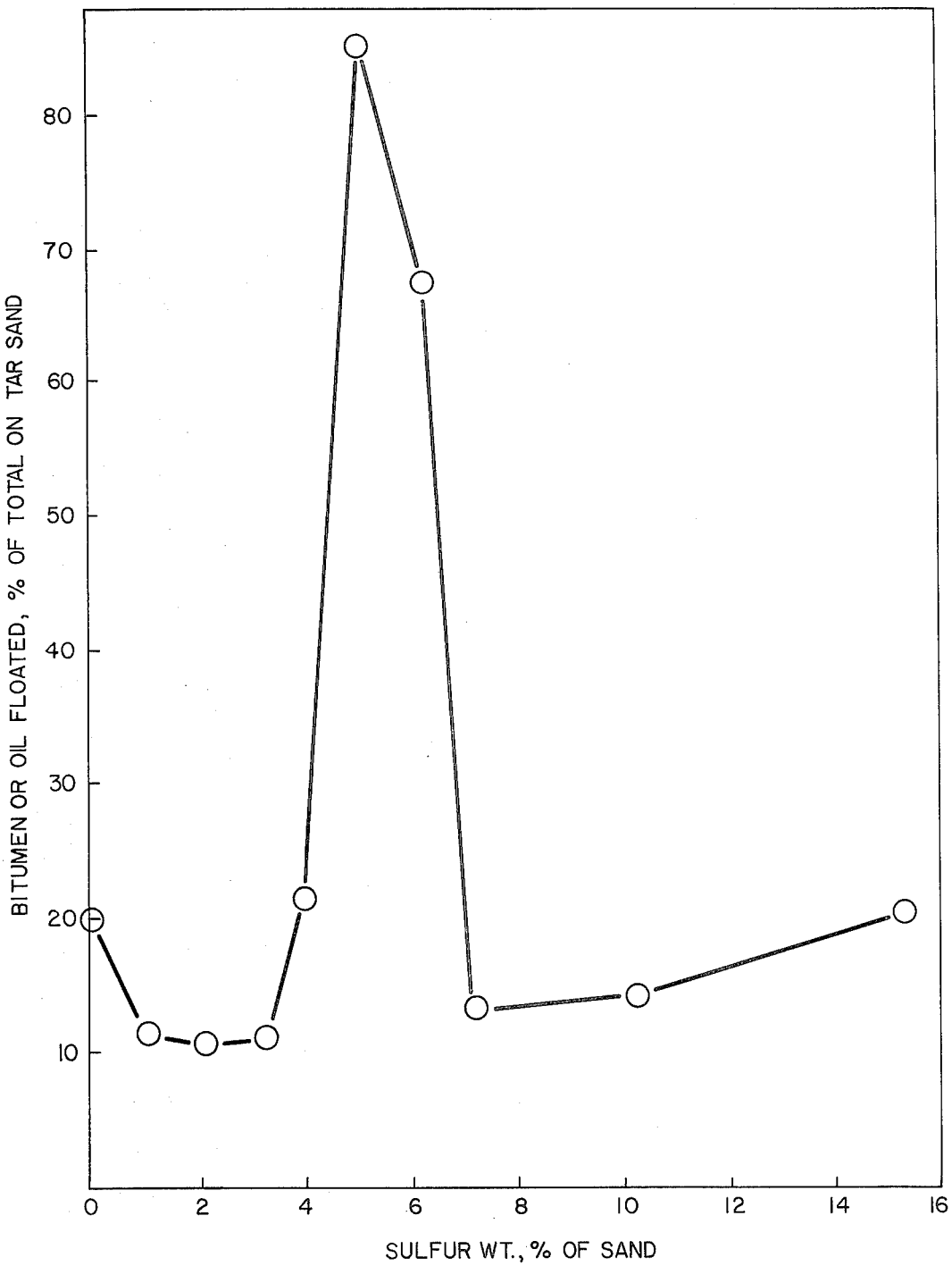
FIG. 2 is a graph illustrating the unexpected optimization of the flotation of tar sand bitumen from the tar sand as a function of sulfur content at 104° F.

This experiment was conducted to study the effect of the amount of bitumen removed from Athabasca tar sands (as a sulfur-bitumen agglomerate) as a function of the amount of sulfur used in the process. The sulfur had a particle size of about 5 microns and water/tar sand ratio was approximately 2/1 by weight. The experiments were conducted at a temperature of 40° C (104° F) in a manner similar to that used in Example 1. That is, progressively increasing increments of sulfur were added to a series of glass containers along with tar sand and water. The containers were about three-quarters full, were stoppered and shaken by hand. The sulfur-bitumen agglomerate floated on top of the water and the sand settled on the bottom. The containers were then frozen, broken and the sulfur-bitumen agglomerate separated from the water and sand. The sulfur-bitumen agglomerate was extracted with pentane in order to determine the bitumen content thereof. The results are plotted in FIG. 2 and show the surprising and unexpected optimization of bitumen removal as a function of the amount of suflur used via the relatively low temperature flotation process of this invention.

TABLE 1

| Graduate | A | B | C |
|---|---|---|---|
| Wt. tar sand | 5.0g | 5.0g | 5.0 |
| Wt. water | 5.0 | 5.0 | 5.0 |
| Wt. sulfur | 0 | 0.5 | 0.235 |
| After Shaking: | | | |
| Surface of Water | black, oil emulsion | clean | Some emulsion particles ~1/5" diameter. |
| Surface of Sand | black, fine grains throughout | large black, single agglomerate, sand flows away | Some particles on surface sand. |
| Glass surface above water level | oil, sticky film | no film; isolated clumps of agglomerate | Some agglomerates stuck to glass. |

What is claimed is:

1. A relativey low temperature process for separating bitumen from natural tar sand comprising mixing granular sulfur particles and water with said tar sand to form a sulfur-bitumen agglomerate phase, a sand phase and a water phase, separating said agglomerate from said sand and water and recovering bitumen from said agglomerate and wherein said sulfur-bitumen agglomerate is formed and separated from the water and sand at a temperature below about 170° F.

2. The process of claim 1 wherein the sulfur-bitumen agglomerate is formed and separated from the water and sand at a temperature between about 90° and 150° F.

3. The process of claim 2 wherein the amount of water employed ranges from between about 40 to 400 wt.% of the tar sand.

4. The process of claim 3 wherein the amount of sulfur used ranges from about 1 to 30 wt.% of the tar sand.

5. The process of claim 3 wherein the average size of the sulfur particles is at least about 5 microns.

6. The process of claim 3 wherein the bitumen is recovered from the sulfur-bitumen agglomerate by heating up said agglomerate to melt the sulfur contained therein to form a liquid sulfur phase and a liquid bitumen phase which floats on said liquid sulfur and separating said liquid bitumen from said liquid sulfur.

7. A relatively low temperature process for separating bitumen from natural tar sands which comprises mixing said tar sands with water and granular sulfur particles, in the presence of air and at a temperature below about 170° F, to form three phases, a sand phase, a water phase and a sulfur-bitumen agglomerate phase said air being entrained in said sulfur-bitumen agglomerate phase as a result of said mixing thereby causing said sulfur-bitumen agglomerate phase to float on top of said water phase, separating said agglomerate from said sand and water and recovering bitumen from said agglomerate.

8. The process of claim 7 wherein the amount of sulfur used ranges from between about 1 to 30 wt.% of the tar sand.

9. The process of claim 8 wherein the temperature ranges between about 90° and 150° F.

10. The process of claim 9 wherein the amount of sulfur ranges from about 2 to 15 wt.% of the tar sand.

11. The process of claim 10 wherein the amount of water ranges between about 40 to 400 wt.% of the tar sand.

12. The process of claim 11 wherein the sulfur has an average particle size of at least about 5 microns.

13. The process of claim 11 wherein the bitumen is recovered from the sulfur-bitumen agglomerate by heating up said agglomerate to melt the sulfur contained therein to form a liquid sulfur phase and a liquid bitumen phase which floats on said liquid sulfur and separating said liquid-bitumen from said liquid sulfur.

* * * * *